US006422000B1

(12) United States Patent
Poggio et al.

(10) Patent No.: US 6,422,000 B1
(45) Date of Patent: Jul. 23, 2002

(54) METHOD FOR ESTIMATING THE TEMPERATURE OF THE EXHAUST GASES UPSTREAM FROM A PRE-CATALYSER, DISPOSED ALONG AN EXHAUST PIPE OF AN INTERNAL-COMBUSTION ENGINE

(75) Inventors: Luca Poggio, Spinetta Marengo; Daniele Ceccarini, Rimini, both of (IT)

(73) Assignee: Magneti Marelli S.p.A. (IT)

( * ) Notice: Subject to any disclaimer, the term of this patent is extended or adjusted under 35 U.S.C. 154(b) by 0 days.

(21) Appl. No.: 09/679,870

(22) Filed: Oct. 5, 2000

(30) Foreign Application Priority Data

Oct. 6, 1999 (IT) ..... B099A0535

(51) Int. Cl.[7] ..... F01N 3/00

(52) U.S. Cl. ..... 60/274; 60/276; 60/277; 123/676; 123/697; 73/118.1

(58) Field of Search ..... 60/274, 276, 277, 60/285; 123/676, 697; 73/118.1, 23.31

(56) References Cited

U.S. PATENT DOCUMENTS 5,605,040 A 2/1997 Cullen et al.
5,606,855 A * 3/1997 Tomisawa ..... 60/274
5,629,473 A * 5/1997 Hayami ..... 73/23.31
5,719,778 A * 2/1998 Suzumura et al. ..... 364/477.01
5,771,688 A * 6/1998 Hasegawa et al. ..... 60/276
5,901,553 A 5/1999 Cullen
5,969,230 A * 10/1999 Sakai et al. ..... 73/23.31

FOREIGN PATENT DOCUMENTS

FR 2771815 6/1999

OTHER PUBLICATIONS

Patent Abstracts of Japan 06033810 2/94.
Patent Abstracts of Japan 11141328 5/99.
EPO Search Report 00121778 Dec. 2000.

* cited by examiner

*Primary Examiner*—Thomas Denion
*Assistant Examiner*—Binh Tran
(74) *Attorney, Agent, or Firm*—Hall, Priddy, Myers & Vande Sande

(57) ABSTRACT

A method is described for estimating the temperature of the exhaust gases upstream from a pre-catalyser disposed along an exhaust pipe of an internal-combustion engine, which is provided with a system for controlling the composition of the exhaust gases, comprising an oxygen sensor, which is disposed along the exhaust pipe, upstream from the pre-catalyser, a heater, which is associated with the oxygen sensor, and a control unit, which, inter alia, serves the purpose of piloting the heater. The method comprises the steps of: determining an operative quantity, which is correlated to an electrical power supplied to the heater, in order to keep the operative temperature of the oxygen sensor close to a target temperature; and determining the temperature of the exhaust gases upstream from the pre-catalyser, according to the said operative quantity.

12 Claims, 2 Drawing Sheets

METHOD FOR ESTIMATING THE TEMPERATURE OF THE EXHAUST GASES UPSTREAM FROM A PRE-CATALYSER, DISPOSED ALONG AN EXHAUST PIPE OF AN INTERNAL-COMBUSTION ENGINE

The present invention relates to a method for estimating the temperature of the exhaust gases upstream from a pre-catalyser disposed along an exhaust pipe of an internal-combustion engine.

BACKGROUND OF THE INVENTION

Systems for controlling the composition of the exhaust gases of intern-combustion engines are known, which require acquisition and processing of a certain series of signals, which can either be measured directly by means or suitable sensors, or can be estimated from other values correlated to the signals, by means of use of predictive models.

For the sake of greater clarity, reference is made of FIG. 1, which illustrates a simplified block diagram of a known system for controlling the composition of the exhaust gases of an engine 20, provided with a pre-catalyser 2, which is disposed along an exhaust pipe 7, in a position which is very close to the engine 20 itself, and a main catalyser 3, which is disposed along the exhaust pipe, downstream from the pre-catalyser 2, in a position further away rom the engine 20.

The control system, which is indicated as 1 as a whole, comprises an oxygen sensor 5, which is disposed upstream from the pre-catalyser 2, and normally consists of a linear LAMBDA or UEGO sensor, and supplies a signal $V_{OX}$ which indicates the quantity of oxygen present in the exhaust gases at the intake of the pre-catalyser 2; a temperature sensor 6, which is disposed downstream from the pre-catalyser 2, between the latter and the main catalyser 3, and supplies a signal $V_T$ which indicates the temperature $T_V$ of the exhaust gases at the output of the pre-catalyser 2 itself, indicated hereafter in the description by the term "temperature downsream"; and a control unit 4 which is connected to the oxygen sensor 5 and to the temperature sensor 6, receives the signals $V_{OX}$ and $V_T$, and, on the basis of these signals, serves the purpose of controlling the composition of the exhaust gases produced by the engine 20.

In order to implement satisfactory control of the composition of the exhaust gases, in addition to the signals $V_{OX}$ and $T_V$, the control unit 4 also needs to have available additional values, which, if they are not in specific operating conditions, cannot be measured either directly or indirectly, and which must therefore be estimated on the basis of the operating conditions of the engine 20 (load, number of revolutions etc.), by means of use of predictive models.

In particular, it is necessary to use predictive models in order to estimate the temperature of the exhaust gases at the intake of the pre-catalyser 2, since this temperature cannot be related directly to the signal supplied by the temperature 6 disposed downstream from the pre-catalyser 2, except in specific operating conditions. In fact, the pre-catalyser 2 is normally the source of exothermal chemical reactions, and consequently the temperature of the exhaust gases increases during passage of the latter through the pre-catalyser 2.

Only in cases when the engine 20 is functioning with an air/fuel (A/F) mixture which is significantly greater than the stoichiometric value (equivalent to 14.56) do the exothermal reactions stop, such that the ratio between the temperature of the exhaust gases at the intake and output of the pre-catalyser becomes known.

The predictive models which are used at present to estimate the temperature of the exhaust gases at the intake of the pre-catalyser 2 nevertheless have some disadvantages.

Firstly, the accuracy of the estimates which can be obtained by means of these predictive models is not always sufficient. In particular, during transient conditions between different operating conditions of the engines, the estimates which are supplied by the known predictive models cannot follow reliably and quickly the variations of the temperature values of the exhaust gases.

In addition, the predictive models which are used at present do not take into account differences from the nominal conditions, owing mainly to ageing of the components, and thus, the estimates which these models provide gradually become increasingly less reliable.

SUMMARY OF THE INVENTION

The object of the present invention is to provide a method for estimating the temperature of the exhaust gases, which is free from the disadvantages described, and which in transient can provide reliable estimates even in transient conditions, without requiring the addition of further sensors.

According to the present invention, a method is thus provided for estimating the temperature of the exhaust gases upstream from a pre-catalyser disposed along an exhaust pipe of an internal-combustion engine, which is provided with a system for controlling the composition of the exhaust gases, comprising oxygen sensor means which are disposed along the said exhaust pipe, upstream from the said pre-catalyser, and means for piloting the said heater means; the said method being characterised in that it comprises the steps of:

a) determining a first operative quantity, which is correlated to the exchange of heat between the said oxygen sensor means and the exhaust gases; and b) determining a temperature of the exhaust gases upstream from the said pre-catalyser, according to the said first operative quantity.

BRIEF DESCRIPTION OF THE DRAWINGS

In order to assist understanding of the present invention, a preferred embodiment is described hereinafter, purely by way of non-limiting example, and with reference to the attached drawings, in which.

DETAILED DESCRIPTION OF THE INVENTION

Figure 1:
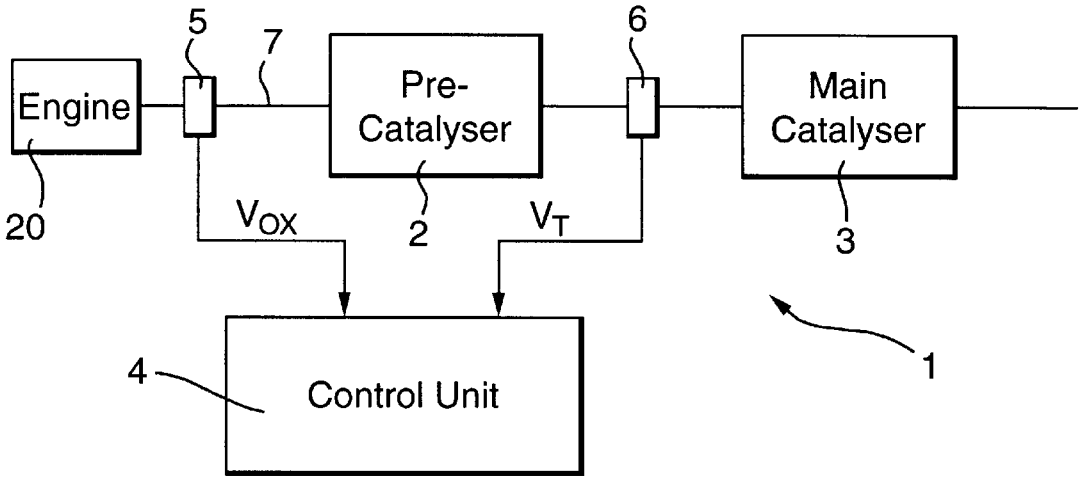
FIG. 1 is a simplified block diagram of a system of a known type for controlling the exhaust gases.

The system for controlling the exhaust gases, which implements the method for estimating the temperature according to the present invention, has a general circuit structure which is similar to that previously described with reference to FIG. 1, and thus hereinafter in the description, parts which are identical to those in FIG. 1 will be indicated by the same reference numbers.

Figure 2:
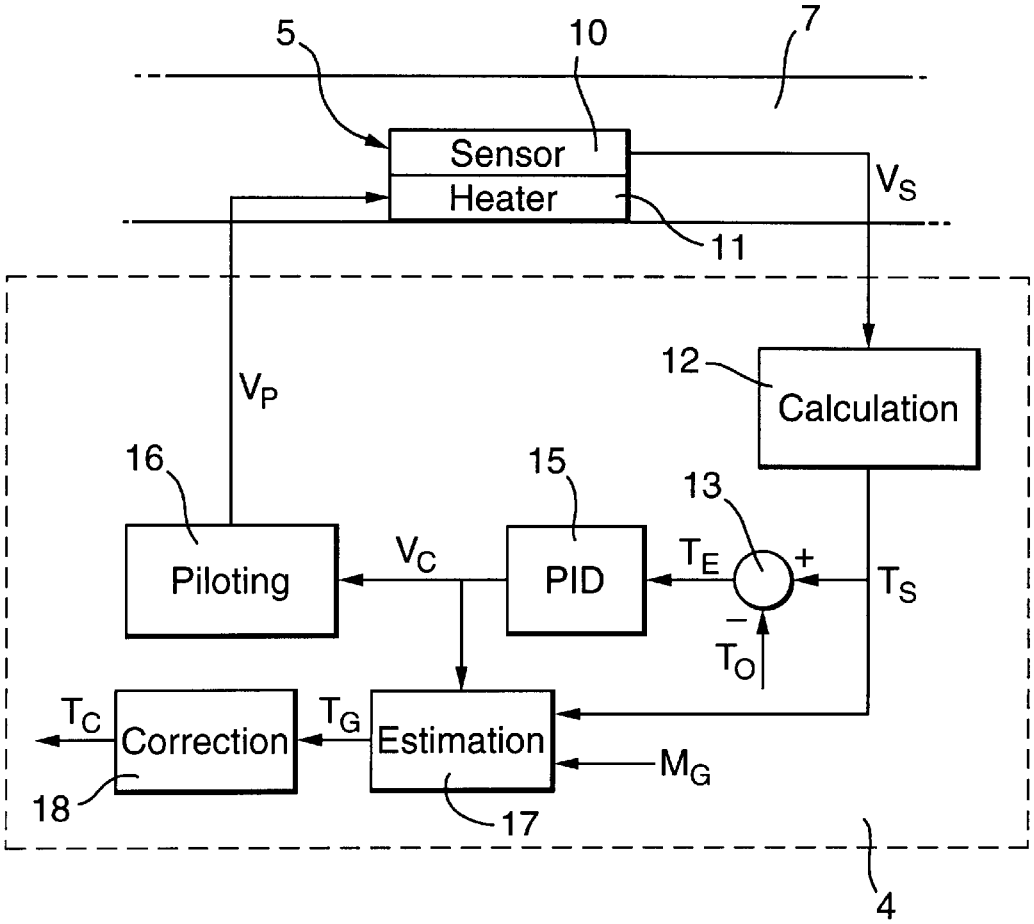
FIG. 2 is a more detailed block diagram of a system for controlling the exhaust gases, which implements the method for estimating the temperature according to the present invention.

FIG. 2 shows a more detailed block diagram of the control unit 4 and of the oxygen sensor 5.

In particular, the oxygen sensor 5 comprises an oxygen sensor 10, which in use is immersed in the exhaust gases, and supplies as output a voltage $V_S$ which is correlated to the internal resistance $R_S$ of the oxygen sensor 10 itself, which is supplied at the intake of the control unit 4; and a heater 11, which is controlled by the control unit 4, and serves the purpose of keeping the temperature of the oxygen sensor 10 within a pre-determined operative interval of values, in which the information supplied by the oxygen sensor 10 is reliable.

The control unit 4 comprises a calculation block 12, which receives as input the voltage $V_S$, and supplies as output operative temperature values $T_S$ or the oxygen sensor 10. In detail, Inside the calculation block 12, the voltage $V_S$ is sampled with a period of sampling ô, and is converted into a digital signal, on the basis of which the calculation block 2 itself determines initially, at each sampling interval and in a manner which is known and is therefore not described in detail, a value of internal resistance $R_S$ of the oxygen sensor 10, and on the basis of this, and of the known ratio which associates the internal resistance $R_S$ and the operative temperature $T_S$ of the oxygen sensor 10, the block then calculates an operative temperature value $T_S$ of the oxygen sensor 10 itself, which is stored in a work memory, which is of a known type and is not shown.

The control unit 4 additionally comprises a subtracter block 13, which receives as input the operative temperature $T_S$ and a target temperature T°, and supplies as output an error signal $T_E$, which is provided by the difference between the operative temperature $T_S$ and the target temperature T°; a controller block 15, which is preferably a controller of the PI (proportional-integral) type, which receives as input the error signal $T_E$ and supplies as output a control voltage $V_C$, which is correlated to the amplitude of the error signal $T_E$ itself; and a block 16 for piloting the heater 11, which receives as input the control voltage $V_C$, and supplies as output a piloting voltage $V_P$, which is supplied to the heater 11, and has an effective value $V_{PEFF}$ such as to supply to the heater 11 itself the electrical power $W_E$ necessary to take the temperature of the oxygen sensor 10 to a value which is close to the value of the target temperature T°, for example 770° C.

The control unit 4 additionally comprises an estimation block 17, which receives as input the control voltage $V_C$, the operative temperature $T_S$, and a value of flow rate $M_G$ of the exhaust gases, and supplies as output a temperature $T_G$ of the exhaust gases at the intake of the pre-catalyser 2, which is indicated hereinafter in the description by the term "temperature upstream", estimated by using an estimation algorithm described in detail hereinafter; and a correction block 18, which receives as input the temperature upstream $T_G$, by implementing an adaptation procedure described in detail hereinafter, and supplies as output a correct temperature $T_C$.

In particular, the method for estimating the temperature upstream $T_G$ of the exhaust gases implemented by the estimation block 17 is based on the fact that the amplitude of the control voltage $V_C$ is correlated to the difference which exists between the real temperature of the exhaust gases and the operative temperature $T_S$ of the oxygen sensor 10. In fact, the control voltage $V_C$ is used to control the effective value $V_{PEFF}$ of the piloting voltage $V_P$, and, consequently, the electrical power $W_E$ which needs to be supplied to the heater 11, in order to compensate for the variations in the temperature of the sensor 10, caused by heat exchange with the surrounding environment, constituted by the exhaust gases which flow in the exhaust pipe 7.

In detail, the estimation block 17 calculates the temperature upstream $T_G$ from the operative temperature $T_S$ of the oxygen sensor 10 and from the control voltage $V_C$, in the manner described hereinafter.

Since no mechanical work is carried out on the oxygen sensor 10, the energy balance, with reference to a sampling period ô between two successive moments of sampling n and n+1, is represented by the equation:

$$\Delta Q_S = \Delta Q_{SG} + \Delta Q_{SR} \tag{1}$$

in which $\Delta Q_S$ is the heat stored by the oxygen sensor 10, whereas $\Delta Q_{SG}$ and $\Delta Q_{SR}$ represent the heat exchanged respectively by the oxygen sensor 10 with the exhaust gases for convection, and with the heater 11 for conduction.

The quantities $\Delta Q_S$, $\Delta Q_{SG}$ and $\Delta Q_{SR}$ are calculated on the basis of the following equations:

$$\Delta Q_S = C[T_S(n=1) - T_S(n)] \tag{2}$$

$$\Delta Q_{SG} = H[T_S(n) - T_G(n)] \tag{3}$$

$$\Delta Q_{SR} = KW_E \tag{4}$$

in which C is the thermal capacity of the oxygen sensor 10, H is the coefficient of convective heat exchange between the oxygen sensor 10 and the exhaust gas, which is dependent on the flow rate of the exhaust gases $M_G$, according to a known ratio, and K is the coefficient of conductive heat exchange between the oxygen sensor 10 and the heater 11.

In addition, the value of the thermal power $W_E$ is provided by the expression:

$$W_E - V^2_{PEFF}/R_H \tag{5}$$

in which $R_H$ is the resistance of the heater 11.

As previously stated, the effective value $V_{PEFF}$ of the piloting voltage $V_P$ depends in a known manner on the control voltage $V_C$ which supplied as input to the estimation block 17.

When the equations (2), (3), (4) and (5) are substituted in (1), the following ratio is obtained:

$$T_S(n+1) = \left(1 - \frac{H}{C}\right)T_S(n) + \frac{H}{C}T_G(n) + \frac{K}{C}\frac{V^2_{PEFF}}{R_H} \tag{6}$$

in which the only unknown term is the temperature upstream $T_G(n)$.

Since the variations in the temperature of the exhaust gases are slow compared with the variations of the electrical values and of the times required for processing of the signals, it is always possible to select an appropriate value for the sampling period ô, such that successive samples of the temperature upstream $T_G$ can be considered approximately equal, i.e.:

$$T_G(n+1) \cong T_G(n) \tag{7}$$

By replacing (7) in (6), the required value of the temperature upstream $T_G$ is obtained, according to the equation:

$$T_G(n+1) = \frac{C}{H}\left[T_S(n+1) - \left(1 - \frac{H}{C}\right)T_S(n) - \frac{K}{H}\frac{V^2_{HEFF}}{R_H}\right] \tag{8}$$

The value supplied by the equation (8) represents the output of the estimation block 17, and is also valid in transient conditions.

Figure 3:
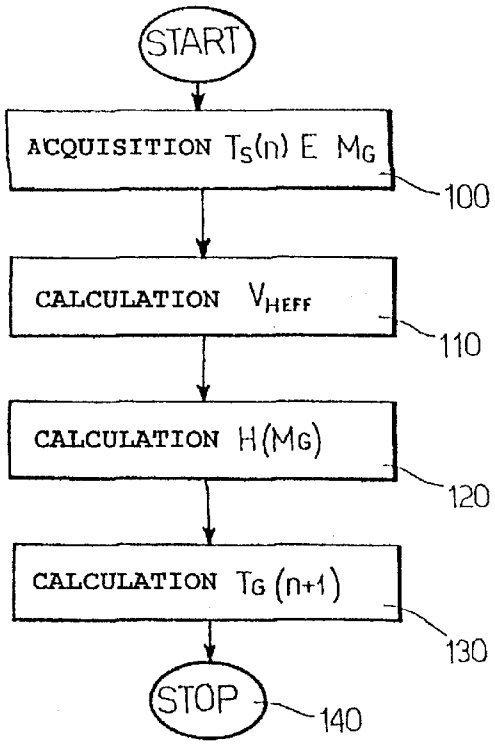

FIG. 3 shows a flow chart relating to the operations implemented by the estimation block 17, in order to calculate the value of the temperature upstream $T_G$.

As illustrated in this figure, initially acquisition takes place of the value of the operative temperature $T_S$ of the oxygen sensor 10 which is stored at the moment n, as well as of the flow rate of the exhaust gases $M_G$ (block 100).

On the basis of the control voltage $V_C$, there is then calculation of the effective value $V_{PEFF}$ of the piloting voltage $V_P$ (block 110), whereas the flow rate of the exhaust gases $M_G$ is used in order to determine the value of the coefficient of convective heat exchange H (block 120).

Finally, the estimation of the temperature upstream of the exhaust gases at the moment n+1 is calculated on the basis of the equation (8) (block 130), and the algorithm is concluded (block 140).

Figure 4:
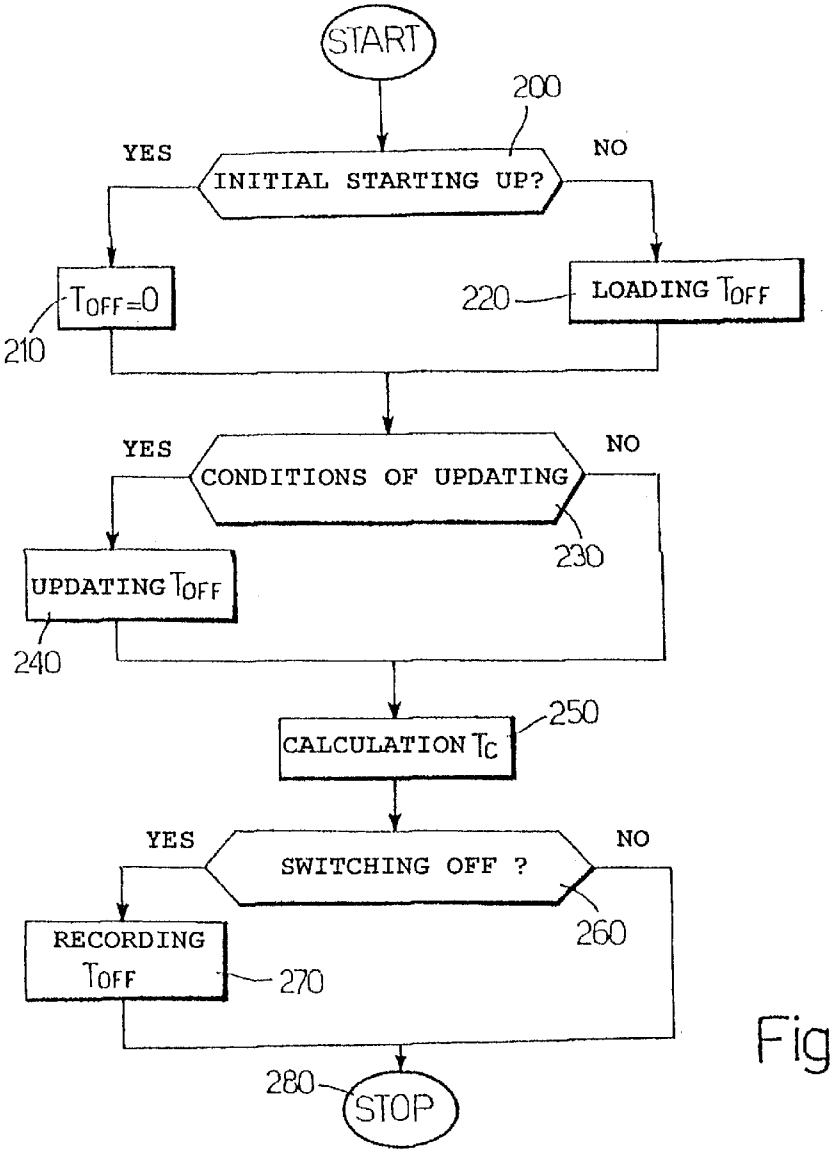
FIGS. 3 and 4 are flow diagrams relative to the method for estimation according to the present invention.

FIG. 4 shows a flow chart relating to the method for adaptation implemented by the correction block 18.

The method for adaptation is based on the fact that, as previously stated, the exothermal reactions within the pre-catalyser 2 stop in specific conditions of operation of the engine 20, and consequently, the temperature gap $T_{GAP}$ of the exhaust gases between the intake and the output of the pre-catalyser 2 itself is constant and known, since a nominal value can be determined experimentally, or calculated in a manner which is well known to persons skilled in the art. Thus, it is also possible to calculate the temperature of the exhaust gases at the intake of the pre-catalyser 2, on the basis of the temperature downstream $T_V$ measured by the temperature sensor 6, and to compare it with the temperature estimated on the basis of the equation (8). Any divergence $T_{OFF}$ is represented by the error which is committed by estimating the temperature upstream $T_G$ in accordance with the equation (8), and is added to the temperature upstream $T_G$ itself, in order to obtain the correct temperature $T_C$, which provides a more accurate estimate.

In detail, the method for adaptation begins with a test to check whether the engine 20 is being started up for the first time (block 200). If this is the case (YES output from the block 200), the divergence $T_{OFF}$ is set to zero (block 210), whereas otherwise (NO output from the block 200), a value of the divergence $T_{OFF}$ stored in a previous operating cycle of the engine 20 is loaded (block 220).

Subsequently, a further test is carried out in order to check whether the conditions exist for carrying out an update of the divergence $T_{OFF}$ (block 230). In particular, it is checked whether the air/fuel ratio (A/F) of the mixture supplied to the engine 20 is kept without interruption above a threshold ratio $(A/F)_S$, which is greater than the stoichiometric value, for a time interval which is greater than a minimum time $\hat{o}_M$. If this condition exists (YES output from block 230), the value of the divergence $T_{OFF}$ is updated on the basis of the equation (block 240):

$$T_{OFF}=T_V+T_{GAP}-T_G \tag{9}$$

If on the other hand the updating condition has not seen found (NO output from block 230), the correct temperature $T_C$ is calculated directly on the basis of the following ratio (block 250):

$$T_C=T_G+T_{OFF} \tag{10}$$

A further test is then carried out, in which it is checked whether switching off of the engine 20 has been ordered (block 260). If the result of the test is negative (NO output from block 260), the updating method is ended (block 280); otherwise (YES output from block 260), before abandoning the method, the present value of the divergence $T_{OFF}$ is scored in a permanent memory, which is of a known type and is not shown, which can retain the value stored even in the absence of a power supply (block 270).

The method for estimation described has the following advantages.

Firstly, the estimation of the temperature upstream $T_G$ is based on processing of the data supplied by the oxygen sensor 5, and not simply on predictive models. Consequently, the temperature value calculated by the estimation block 17, in accordance with the equation (8), represents a more accurate estimate than those supplied by the conventional methods. In particular, the method makes it possible to calculate accurately the temperature upstream $T_G$ even in transient conditions.

Secondly, the method can adapt the calculation of the temperature upstream $T_G$, and supply a correct temperature $T_C$, which takes into account any differences from the nominal operative conditions. By this means, for example, it s possible to compensate for the variations caused by ageing of the components, thus preventing deterioration of the performance of the system.

In addition, the present method for estimation advantageously makes it possible to obtain the results illustrated by using only the sensors which are already present in the systems currently available, and therefore without needing to use a larger number of sensors.

Finally, it is apparent that modifications and variants can be made to the method for estimation described, which do not depart from the protective context of the present invention.

In particular, the regulation function implemented by controller block 15 can be of the proportional-derivative (PD) type, proportional-integral-derivative (PID) type, or of another type.

What is claimed is:

1. A method for controlling the composition of exhaust gases and for estimating a temperature of the exhaust gases at a location upstream from a pre-catalyser (2) disposed along an exhaust pipe (7) of an internal-combustion engine (20), which is provided with a system (1) for controlling said composition of the exhaust gases which comprises oxygen sensor means (10) disposed along said exhaust pipe (7) upstream from said pre-catalyser (2), heater means (11) associated with said oxygen sensor means (10), and means (12, 13, 15, 16) for piloting the heater means (11); the method comprising the steps of:

(a) determining a first operative quantity ($V_{PEFF}$) which is correlated to the exchange of heat between the oxygen sensor means (10) and the exhaust gases and determining a second operative quantity ($V_{PEFF}$) which is correlated to an electrical power ($W_E$) dissipated by the said heater means (11) to maintain an operative temperature ($T_S$) of the oxygen sensor means (10) which is close to a target temperature ($T^O$); wherein the determination of the first operative quantity ($V_{PEFF}$) includes determining the operative temperature ($T_S$) of the oxygen sensor means (10) and generating a pilot signal ($V_P$) for the heater means (11) according to the operative temperature ($T_S$) determined and the target temperature ($T^O$); and (b) determining a temperature ($T_G$) of the exhaust gases upstream from the pre-catalyser (2) according to the first operative quantity ($V_{PEFF}$); wherein said determination of the temperature ($T_G$) comprises determining the temperature ($T_C$) of the exhaust gases upstream from the pre-catalyser (2) according to the piloting signal ($V_P$).

2. The method according to claim 1, characterized in that the said step of generating the piloting signal ($V_P$) comprises the step of:

generating the said piloting signal ($V_P$) according to a regulation function which is at least of the proportional-integral type.

3. The method according to claim 1, characterized in that the step of determining the temperature $T_G$ of the exhaust gases upstream from the said pre-catalyser (2) according to the said piloting signal ($V_P$) comprises the step of:

determining the temperature ($T_G$) of the exhaust gases upstream from the said pre-catalyser (2), according to an effective value ($V_{PEFF}$) of the piloting signal ($V_P$).

4. The method according to claim 1, characterized in that, in the step of determining the temperature ($T_G$) of the exhaust gases upstream from the said pre-catalyser (2) according to an effective value ($V_{PEFF}$) of the piloting signal ($V_P$), the temperature ($T_G$) of the exhaust gases upstream from the pre-catalyser (2) is calculated according to the equation:

$$T_G(n+1) = \frac{C}{H}\left[T_S(n+1) - \left(1 - \frac{H}{C}\right)T_S(n) - \frac{K}{H}\frac{V_{PEFF}^2}{R_H}\right];$$

in which n is a discrete temporal index; $T_G$ is the temperature of the exhaust gases upstream from the pre-catalyser (2); $T_S$ is the pre-determined operative temperature; $V_{PEFF}$ is the effective value of the piloting signal ($V_P$); C is a thermal capacity of the oxygen sensor means (10); H is a coefficient of convective heat exchange between the oxygen sensor means (10) and the exhaust gases; K is a coefficient of conductive heat exchange between the oxygen sensor means (10) and the heater means (11); and ($R_H$) is a resistance of the heater means (11).

5. The method according to claim 1, characterized in that the step of determining the operative temperature ($T_S$) comprises the steps of:

determining the operative resistance ($R_S$) of the oxygen sensor means (10); and determining the operative temperature ($T_S$) of the oxygen sensor means (10) according to the operative resistance ($R_S$).

6. The method according to claim 5, for a control system (1), comprising temperature sensor means (6) which are disposed along the exhaust pipe (7), downstream from the pre-catalyser (2), and supply a temperature signal ($V_T$ ) which is correlated to a temperature ($T_V$) of the exhaust gases downstream from the pre-catalyser (2), characterized in that the step of determining the operative resistance ($R_S$) comprises the step of determining the operative resistance ($R_S$) of the oxygen sensor means (10) according to the temperature signal ($V_T$).

7. The method according to claim 5, comprising the further steps of:

updating a corrective term ($T_{OFF}$); and calculating a correct temperature value ($T_C$) according to the temperature of the exhaust gases ($T_G$) upstream from the said pre-catalyser (2) and according to the corrective term ($T_{OFF}$).

8. The method according to claim 7, characterised in that the step of updating the said corrective term ($T_{OFF}$) comprises the steps of:

checking updating conditions; and calculating an updated value of the corrective term ($T_{OFF}$) in the presence of the updating conditions.

9. The method according to claim 8, characterised in that the step of checking updating conditions comprises the step of:

checking whether an air/fuel (A/F) ratio of a mixture supplied to an engine (20) which emits the exhaust gases, is kept without interruption above a threshold ratio $(A/F)_S$, for a period of time greater than a minimum time ($\hat{O}_M$).

10. The method according to claim 9, characterised in that the updated value of the corrective term ($T_{OFF}$) is calculated according to the equation:

$$T_{OFF}=T_V+T_{GAP}-T_G;$$

in which $T_{OFF}$ is the updated value of the corrective term; $T_V$ is the temperature of the exhaust gases downstream from the pre-catalyser (2); and $T_{GAP}$ is a nominal temperature difference in the updating conditions.

11. The method according to claim 7, characterised in that the correct temperature value $T_C$ is calculated according to the equation:

$$T_C=T_G+T_{OFF}$$

in which $T_C$ is the correct temperature value.

12. The method according to claim 1, characterised in that the oxygen sensor means (10) comprise a linear LAMBDA-type sensor.

* * * * *